United States Patent [19]

Tiegel

[11] Patent Number: 4,546,812

[45] Date of Patent: Oct. 15, 1985

[54] METHOD AND APPARATUS FOR IMPROVING THE DENSITIES OF CAST PARTS

[75] Inventor: Ralph G. Tiegel, San Carlos, Calif.

[73] Assignee: Tiegel Manufacturing Company, Belmont, Calif.

[21] Appl. No.: 537,650

[22] Filed: Sep. 30, 1983

[51] Int. Cl.[4] ..... B22D 23/00; B22D 39/00; B22D 41/08

[52] U.S. Cl. ..... 164/130; 164/136; 164/326; 164/335; 164/410; 222/162; 222/481.5; 222/600

[58] Field of Search ..... 164/130, 136, 335, 410, 164/324, 325, 326, DIG. 1; 222/590, 591, 600, 598, 481.5, 162

[56] References Cited

U.S. PATENT DOCUMENTS

| | | | |
|---|---|---|---|
| 1,387,864 | 8/1921 | Pepper | 164/130 X |
| 2,551,842 | 5/1951 | Kirchner | 222/481.5 X |
| 3,128,912 | 4/1964 | Cash | 222/590 X |
| 3,208,637 | 9/1965 | Heick | 222/590 X |
| 4,180,120 | 12/1979 | Eberle | 164/130 X |

FOREIGN PATENT DOCUMENTS

| | | | |
|---|---|---|---|
| 959754 | 3/1957 | Fed. Rep. of Germany | 164/325 |
| 2371985 | 7/1978 | France | 164/335 |
| 49-15139 | 4/1974 | Japan | 164/136 |
| 275328 | 10/1970 | U.S.S.R. | 164/130 |

*Primary Examiner*—Nicholas P. Godici
*Assistant Examiner*—J. Reed Batten, Jr.
*Attorney, Agent, or Firm*—Anthony S. Volpe

[57] ABSTRACT

A method and apparatus for casting parts comprising an open-faced mold which is displaced under a ladle. As the mold cavities, defined in the face of the mold, pass beneath the ladle, each is filled with molten material via a sprue in the bottom of the ladle. The ladle includes a venting conduit positioned within the sprue so that as the molten material empties into a mold cavity from the ladle, the air trapped within the mold cavity is vented through the sprue via the venting conduit.

10 Claims, 4 Drawing Figures

METHOD AND APPARATUS FOR IMPROVING THE DENSITIES OF CAST PARTS

BACKGROUND OF THE INVENTION

The present invention relates to improving the density of cast parts. In particular the invention relates to improving the density of cast lead parts and most particularly to improving the density of cast lead parts which are used in the construction of lead-acid storage batteries.

A variety of lead parts, such as battery posts, lugs, etc., are used in the construction of lead-acid storage batteries and are generally referred to as small parts. These battery parts are subject to the corrosive effects of the battery acid and acid gases as well as the stresses, shocks, vibrations and strains associated with battery manufacturing and usage. Storage batteries used in vehicles, such as trucks, cars, and the like, are particularly subject to rough abusive treatment. The failure of a single cast part can render the entire battery useless.

One technique for casting lead battery parts is to employ an open mold having mold cavities defined therein and configured to produce the respective parts. The mold is passed beneath a ladle containing molten lead to position each of the cavities thereunder. As a cavity becomes positioned beneath the ladle, the molten lead pours into the cavity via a sprue in the bottom of the ladle. Another technique is to use a stationary mold and a movable ladle.

Although the previously described casting technique may produce satisfactory parts, often the air which is contained in the mold cavity is trapped within the part as cast. This trapped air forms imperfections in the cast parts which can result in reject parts and/or weaken the parts and causes them to fail during usage.

SUMMARY AND OBJECTS OF THE INVENTION

The disclosed casting apparatus employs a unique ladle which is used in combination with an open-faced mold positioned under the ladle. As the mold cavities are presented beneath the ladle, each mold is filled with molten lead via a sprue in the bottom of the ladle. The disclosed ladle includes a venting conduit positioned within the sprue so that as the lead empties into a mold cavity from the ladle, the air trapped within the mold cavity is vented.

The evacuation of air from the mold cavity is particularly effective due to the location of the venting conduit. The conduit is located within the ladle and is heated by the molten material therein. This heating of the conduit creates an updraft which draws out the air trapped within the mold cavity as it is filled by the molten material.

It is an object of the present invention to provide an improved casting ladle.

It is an object of the present invention to provide a method and apparatus for casting parts or the like which reduce the likelihood of air becoming trapped within the parts during casting.

In particular, it is an object of the present invention to achieve improved lead casting densities in parts produced by an open mold casting technique.

Other objects and advantages of the present invention will become apparent from the following portion of the specification and from the accompanying drawings which illustrate a presently preferred embodiment incorporating the principles of the invention.

DETAILED DESCRIPTION OF THE PREFERRED EMBODIMENT

Figure 1:
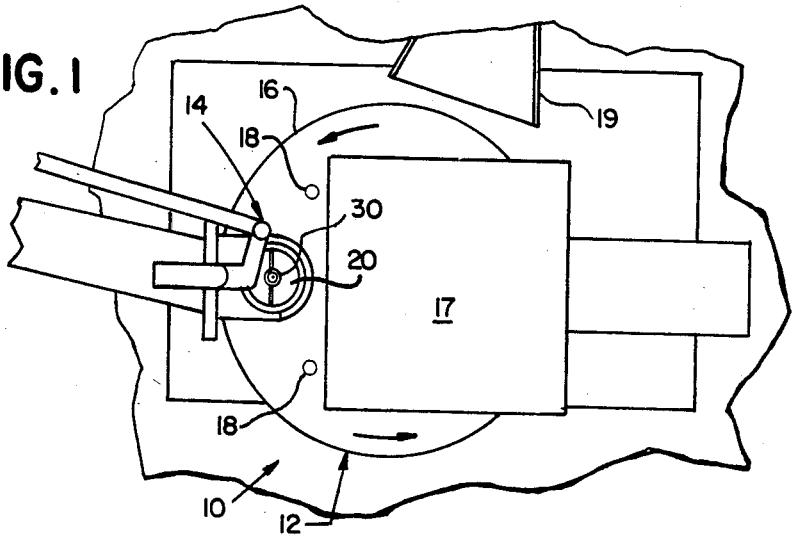
FIG. 1 is a partial view of a casting apparatus in accordance with the teachings of the present invention.

With reference to FIG. 1, the casting apparatus 10 generally comprises an open-faced mold assembly 12 and a ladle assembly 14. The surface 16 of the mold assembly 12 has a plurality of mold cavities 18 defined therein. The mold cavities 18 are selectively configured to produce the desired parts, such as battery posts, lugs, etc. The configuration of the mold cavities and the selection thereof will be known to those skilled in the art. The mold assembly 12 is rotated beneath the ladle assembly 14 to fill each of the cavities 18 with molten casting material, such as lead. Thereafter, the filled cavities pass through a cooling station 17 to solidify the parts which are then ejected onto a collection ramp 19 by conventional means.

Figure 3:
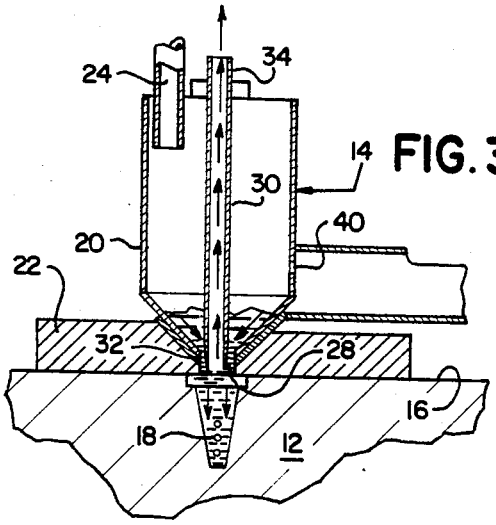
FIG. 3 is a sectional view illustrating the ladle and a casting apparatus after movement from the position shown in FIG. 2 and into position for the casting of a part.
Figure 2:
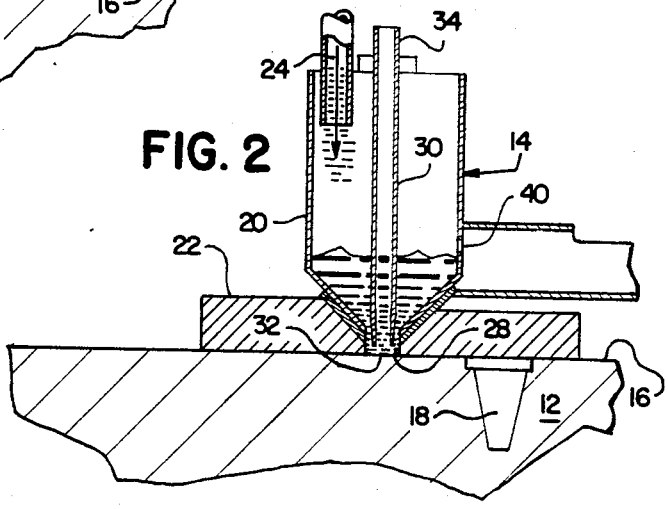
FIG. 2 is a sectional view illustrating the ladle and a casting apparatus, such as shown in FIG. 1, prior to casting.

As best seen in FIG. 2, the ladle assembly 14 includes a vessel 20 supported by a ladle shoe 22 which rests upon the surface 16 of the mold assembly 12. Ladle shoe 22 is planar and is finished to rest upon and slide over surface 16. The ladle shoe 22 must move across the surface 16 without damage and covers the mold cavity prior to casting. Ladle assembly 14 is held in cantilevered fashion by a supporting arm. This permits the ladle assembly 14 to rest upon and complement the mold assembly 12 while permitting the mold assembly 12 to rotate. Likewise, the mold assembly 12 could be stationary and the support arm rotatable with respect thereto. Molten material is introduced into the vessel 20 via fill tube 24 and exits the vessel 20 via sprue 28. Sprue 28 is formed by tapering one end of vessel 20 to form a funnel like tip. As can be seen with reference to FIG. 4, sprue 28 is generally in the same plane of the shoe 22 but is provided with a slight clearance. This clearance is only large enough to permit some wear of shoe 22 before sprue 28 and venting conduit 30 contact surface 16. It will be appreciated, by those skilled in the art, that machine tolerances and impurities prevent the accomplishment of a flush fit between shoe 22 and surface 16 after repeated casting and that such a tolerance is necessary to prevent damage of surface 16. Venting conduit 30 is mounted within the ladle assembly 14 and is open ended. Venting conduit 30 is positioned within the vessel 20 such that the end 32 is centered within the sprue 28 and end 32 of venting conduit 30 lies generally in a common plane with the end of sprue 28. The other end 34 of venting conduit 30 is positioned so as to extend beyond the fill tube 24 and to communicate with the atmosphere. In the preferred embodiment end 34 extends beyond fill tube 24 so as to prevent the molten material from entering the venting conduit 30 when vessel 20 is supplied. In the preferred embodiment venting conduit 30 is stainless steel, however, other materials, such as ceramics, which have the ability to withstand casting temperatures and surfaces which will not interfere with material flow may be used. One advantage to stainless steel is its rigidity which permits the mounting of venting conduit 30 from the top of vessel 20 as shown in FIGS. 1 and 3. In the preferred embodiment sprue 28 has an inside diameter of approximately 0.375 inches and venting conduit 30 in the area of sprue 28 has an outer diameter on the order of 0.3125 inches.

Figure 4:
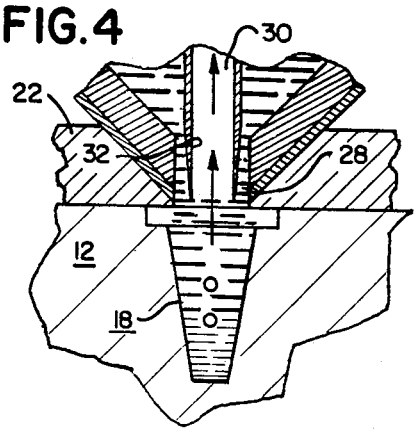
FIG. 4 is an enlarged fragmentary view of the ladle and mold shown in FIG. 3.

With reference to FIG. 4, the location of the venting conduit 30 within the vessel 20 provides enhanced venting of air from the mold cavities 18. The venting conduit 30, especially in the areas adjacent end 32, becomes heated by the molten material in ladle 20. This heating of the venting conduit creates an updraft therein which tends to draw out the air trapped within the mold cavity as it is filled by the molten material pouring in about the conduit. Ideally, the sprue 28 of vessel 20 is dimensioned such that the outside diameter of the sprue is within the outside diameter of the mold but is sufficiently large to accommodate the volume of material necessary for casting and to permit a venting conduit 30 of sufficient size to permit air flow from the mold. Ladle shoe generally closes the mold cavity area to the atmosphere and assures the heat necessary to permit effective casting. It will be appreciated that if desired, more than one ladle may be provided in ladle assembly 14 for the casting of parts requiring large or more complex molds.

In the preferred embodiment, the ladle assembly 14 also comprises an overflow means 40 which defines the level to which molten material is supplied. This fill level is preferably defined such that the amount of material within the vessel 20 is at least equal the volume necessary to cast the respective parts.

In operation, the fill tube 24 supplies molten casting material to the vessel 20 while the sprue 28 is blocked by the mold surface 16. As the vessel 20 is supplied some of the molten material flows through end 32 and into venting conduit 30 (FIG. 2).

The ladle assembly 14 and the mold assembly 12 are moved relative to each other so that the sprue 28 communicates with one of the mold cavities and the molten material flows from vessel 20 and into the mold cavity 18. In particular, it is noted that the material which had entered the end 32 of the venting conduit 30 drops into the mold cavity 18. The air trapped within the cavity is evacuated via the venting conduit 30 while the molten material in vessel 20 continues to pour into the mold cavity 18 about the venting conduit 30 (FIGS. 3 and 4).

After the mold cavity 18 has been filled, the mold is moved in preparation for casting the next part. The process is repeated so that a part will be cast in each of the respective mold cavities 18.

What I claim is:

1. An apparatus for casting parts comprising:

ladle assembly means for receiving molten casting material preparatory to casting, said ladle assembly means including:

a ladle sprue in the bottom thereof communicating with mold means; and venting means positioned within said sprue for venting air during casting;

said mold means relatively displaceable with respect to said ladle assembly means including:

a surface for supporting said ladle assembly means and closing said sprue; and at least one mold cavity locatable under said ladle means for casting; and means for moving said ladle assembly means and mold means relative to each other and to locate said sprue over said mold cavity.

2. An apparatus according to claim 1 wherein said mold cavity is configured to form a small battery part.

3. An apparatus according to claim 1 further comprising:

a plurality of selectively configured mold cavities defined in said mold means;

each said cavity locatable beneath said ladle means for casting; and means for selectively filling said ladle means with molten casting material prior to the location of each respective cavity beneath said ladle means.

4. An apparatus according to claim 3 wherein said mold cavities are configured to form relatively small, non-complex battery parts.

5. An apparatus according to claim 3 wherein said filling means supplies said ladle means with a volume of molten casting material at least equal to the volume of each respective cavity prior to casting.

6. An apparatus according to claim 5 wherein said mold cavities are configured to form relatively small, non-complex battery parts.

7. A method of casting parts, comprising the steps of:

providing a mold means having a mold cavity therein;

providing a ladle means having molten casting material therein, said ladle means comprising a ladle, a sprue in the bottom of said ladle and a venting means extending from said sprue and back through said ladle, said ladle means supported upon and said sprue and said venting means closed off by the surface of said mold means;

displacing said ladle means and said mold means relative to each other, such that said sprue and said venting means are opened and in communication with said mold cavity, whereby said casting material flows from said ladle means into said mold cavity and air is vented from said mold cavity through said venting means during the flow of the casting material into said mold cavity.

8. A method according to claim 7 further comprising:

creating an updraft within said venting means for enhancing said venting.

9. A method according to claim 8 further comprising:

providing a plurality of selectively defined mold cavities in the face of said mold means;

relatively displacing said ladle means and said mold means to locate each of said cavities successively beneath said ladle means; and selectively filling said ladle means with molten casting material prior to location of each respective cavity therebeneath.

10. A method according to claim 9 wherein said ladle means is selectively filled with a volume of molten casting material at least equal to the volume of each respective cavity.

* * * * *